US008439492B2

(12) United States Patent
Aoki et al.

(10) Patent No.: US 8,439,492 B2
(45) Date of Patent: May 14, 2013

(54) CARTRIDGE AND METHOD FOR MANUFACTURING THE SAME

(75) Inventors: Yuji Aoki, Matsumoto (JP); Masahiro Karasawa, Matsumoto (JP); Masaru Takahashi, Matsumoto (JP); Yoshikatsu Yamamoto, Nagano-ken (JP); Hisao Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/305,070

(22) Filed: Nov. 28, 2011

(65) Prior Publication Data

US 2012/0147102 A1 Jun. 14, 2012

(30) Foreign Application Priority Data

Dec. 8, 2010 (JP) ..... 2010-273266

(51) Int. Cl.
*B41J 2/175* (2006.01)

(52) U.S. Cl.
USPC ..... 347/86; 347/85

(58) Field of Classification Search ..... 347/7, 84, 347/86, 87, 85
See application file for complete search history.

(56) References Cited

U.S. PATENT DOCUMENTS 6,322,205 B1 * 11/2001 Childers et al. ..... 347/85
6,848,775 B2 2/2005 Ishizawa et al.
7,404,628 B2 7/2008 Naka et al.
7,731,344 B2 6/2010 Iwamuro et al.
7,926,926 B2 * 4/2011 Ishizawa et al. ..... 347/86
2007/0243104 A1 10/2007 Aoki et al.

FOREIGN PATENT DOCUMENTS

JP 2001-328272 A 11/2001
JP 2004-306604 A 11/2004
JP 2007-307894 A 11/2007
JP 2008-037016 A 2/2008

* cited by examiner

*Primary Examiner* — Anh T. N. Vo

(74) *Attorney, Agent, or Firm* — Stroock & Stroock & Lavan LLP

(57) ABSTRACT

A cartridge includes: a liquid container adapted to contain a liquid; a filler port provided to fill the liquid into the liquid container; a supply port connected with a liquid supply tube provided in the printing device; a connection port provided to communicate with the liquid container; a liquid detection chamber adapted to vary volume according to inflow or non-inflow of the liquid through the connection port; a flow path arranged to connect the liquid detection chamber with the supply port; and a member provided to have the filler port, the supply port, the liquid detection chamber and the connection port arranged on one identical surface. The surface of the member has the supply port and the filler port arranged on one direction side relative to center of the surface, and the connection port arranged on an opposite direction side to the one direction side relative to the center. The liquid detection chamber is located between the connection port and the supply port.

17 Claims, 13 Drawing Sheets

CARTRIDGE AND METHOD FOR MANUFACTURING THE SAME

CROSS-REFERENCE TO RELATED APPLICATION

The present application claims the priority based on Japanese Patent Application No. 2010-273266 filed on Dec. 8, 2010, the disclosure of which is hereby incorporated by reference in its entirety.

BACKGROUND

1. Technical Field

The present invention relates to a cartridge and a method for manufacturing the same.

2. Related Art

A liquid ejection device adapted to eject a liquid, such as ink, from jet nozzles, for example, an inkjet printing apparatus, is provided with a liquid container provided to contain a liquid, such as a cartridge, as the supply source of the liquid. The liquid container is attached to the liquid ejection device in a replaceable manner. When the liquid in the liquid container is consumed, the empty liquid container is replaceable with a new liquid container.

In order to inform the user of the replacement timing of the liquid container, the liquid container may be provided with a liquid detector, which is located between a liquid container adapted to contain the liquid and a supply port arranged to supply the contained liquid to outside of the liquid container and serves to detect consumption of the liquid in the liquid container. For example, a liquid detector described in JP-A-2007-307894 has a liquid detection chamber, which is formed by a recess and a film covering the recess and is filled with the liquid supplied from the liquid container. A pressure-receiving member and a spring are provided inside the liquid detection chamber. The spring presses the film in one direction via the pressure-receiving member. When the liquid of or over a predetermined level remains in the liquid container, the liquid is supplied to the liquid detection chamber, so that the pressure of the liquid and the pressure of the spring are applied onto the film covering the recess in the liquid detector. When the volume of the liquid remaining in the liquid container decreases below the predetermined level, however, no liquid is supplied to the liquid detection chamber, so that the film does not receive the pressure of the liquid. This results in changing the position of the film (and the pressure-receiving member). The technique described in JP-A-2007-307894 detects the state of remaining liquid in the liquid container according to the positional change of the pressure-receiving member.

In the prior art liquid container, however, the structure of the liquid detection chamber may make it difficult to expel the air bubbles entering the liquid detection chamber, for example, during the operation of filling the liquid. The air bubbles remaining in the liquid detection chamber may lower the detection accuracy of the state of remaining liquid by the liquid detector. Consequently, there is a need to readily expel air bubbles out of not only the liquid detection chamber but the whole liquid container.

SUMMARY

In order to solve at least part of the foregoing problems, the invention provides various aspects and embodiments described below.

According to a first aspect of the invention, there is provided a manufacturing method of a cartridge adapted to be removably attached to a printing device.

The cartridge comprises: a liquid container adapted to contain a liquid; a filler port provided to fill the liquid into the liquid container; a supply port connected with a liquid supply tube provided in the printing device; a connection port provided to communicate with the liquid container; a flow path arranged to connect the connection port with the supply port; and a member provided to have the filler port, the supply port and the connection port arranged on one identical surface, wherein the surface of the member has the supply port and the filler port arranged on one direction side relative to center of the surface, and the connection port arranged on an opposite direction side to the one direction side relative to the center.

The manufacturing method comprises the steps of:

(a) injecting the liquid into the liquid container through the filler port;

(b) after the step (a), setting an attitude of the cartridge to a first attitude that the filler port is located above the connection port in a vertical direction and a normal vector of the surface is inclined upward in the vertical direction from a horizontal direction at an angle of not less than +1 degree and less than +90 degrees, and expelling air bubble from the filler port and the supply port in the first attitude; and (c) after the step (b), closing the filler port.

The manufacturing method according to this aspect sets the attitude of the cartridge to the first attitude, so as to move the air bubbles entering the liquid container toward the filler port. This enables the air bubbles to be readily expelled out of the liquid container via the filler port. The air bubbles are simultaneously expelled from the supply port. This ensures removal of the air bubbles in the flow path connecting the connection port with the supply port.

In the manufacturing method according to the above aspect, at least part of the flow path may be arranged to be directed in an opposite direction to a direction, in which the supply port is directed. The manufacturing method may further comprise the step of (d) after the step (b), changing the attitude of the cartridge from the first attitude to a second attitude that the filler port is located above the connection port in the vertical direction and the normal vector of the surface is inclined upward in the vertical direction from the horizontal direction at an angle of not less than −45 degrees and less than +1 degree, and expelling air bubble from the supply port in the second attitude. Changing the attitude of the cartridge from the first attitude to the second attitude ensures efficient removal of the air bubbles in the flow path, even when the flow path arranged to connect the connection port with the supply port is directed in the opposite direction to the direction, in which the supply port is directed.

In the manufacturing method according to the above aspect, the step (d) may expel part of the filled liquid together with the air bubble. This causes the air bubbles to be guided by the liquid flow and thereby ensures smooth removal of the air bubbles.

In the manufacturing method according to the above aspect, the angle in the second attitude may be not less than −40 degrees and not greater than 0 degree. This ensures more efficient removal of the air bubbles.

In the manufacturing method according to the above aspect, the step (b) may expel part of the filled liquid together with the air bubble. This causes the air bubbles to be guided by the liquid flow and thereby ensures smooth removal of the air bubbles.

In the manufacturing method according to the above aspect, the step (a) may inject the liquid after setting the cartridge in the first attitude. This facilitates the liquid filling operation.

The manufacturing method according to the above aspect may further comprise the step of: (d) prior to the step (a), reducing pressure in the liquid container. This facilitates the liquid filling operation.

In the manufacturing method according to the above aspect, the step (a) may inject the liquid while bringing a restriction tool adapted to restrict expansion of the liquid container into contact with the cartridge. This prevents excessive expansion of the cartridge.

In the manufacturing method according to the above aspect, the angle in the first attitude may be not less than +5 degrees and not greater than +85 degrees. This ensures more efficient removal of the air bubbles.

According to a second aspect of the invention, there is provided a cartridge manufactured by the manufacturing method according to the first aspect.

According to a third aspect of the invention, there is provided a cartridge adapted to be removably attached to a printing device. The cartridge comprises: a liquid container adapted to contain a liquid; a filler port provided to fill the liquid into the liquid container; a supply port connected with a liquid supply tube provided in the printing device; a connection port provided to communicate with the liquid container; a liquid detection chamber adapted to vary volume according to inflow or non-inflow of the liquid through the connection port; a flow path arranged to connect the liquid detection chamber with the supply port; and a member provided to have the filler port, the supply port, the liquid detection chamber and the connection port arranged on one identical surface, wherein the surface of the member has the supply port and the filler port arranged on one direction side relative to center of the surface, and the connection port arranged on an opposite direction side to the one direction side relative to the center, and the liquid detection chamber is located between the connection port and the supply port.

The cartridge according to this aspect may be set in the attitude that the supply port and the filler port are located above the connection port in the vertical direction, so as to efficiently expel the air bubbles through the supply port and the filler port after the liquid filling operation. The cartridge may be used in the attitude that the connection port is located below the filler port and the supply port in the vertical direction, so as to ensure efficient consumption of the liquid.

The cartridge according to the above aspect may further comprise: a pressure-receiving member provided inside the liquid detection chamber; and a pressing member provided to press a variable element, which is provided in part of the liquid detection chamber, via the pressure-receiving member from inside of the liquid detection chamber, wherein the pressure-receiving member has a receiving element adapted to receive the pressing member, and a cutout formed in part of the receiving element. The cutout provided in the receiving element of the pressure-receiving member effectively prevents air bubbles from being accumulated on the receiving element.

In the cartridge according to the above aspect, the liquid container may have a side along the surface, the filler port may be connected with one end of the side, and the connection port may be connected with the other end of the side. Setting the cartridge in the attitude that the supply port and the filler port are located above the connection port in the vertical direction enables the air bubbles to be expelled more efficiently through the supply port and the filler port after the liquid filling operation. Using the cartridge in the attitude that the connection port is located below the filler port and the supply port in the vertical direction allows more efficient consumption of the liquid.

In the cartridge according to the above aspect, the filler port may be closed after the liquid is injected into the liquid container. This effectively prevents leakage of the liquid through the filler port during use of the cartridge.

The cartridge according to the above aspect may further comprise: a casing adapted to accommodate the liquid container and the member. The casing advantageously protects the liquid container and the member.

In the cartridge according to the above aspect, the surface may be formed in an approximately rectangular shape. This advantageously simplifies the structure of the cartridge.

In the cartridge according to the above aspect, the filler port, the supply port, the liquid detection chamber and the connection port may be arranged along a longitudinal direction of the surface. This enables the filler port, the supply port, the liquid detection chamber and the connection port to be efficiently laid out on the approximately rectangular member.

DESCRIPTION OF THE PREFERRED EMBODIMENTS

A. Device Structure

Figure 1:
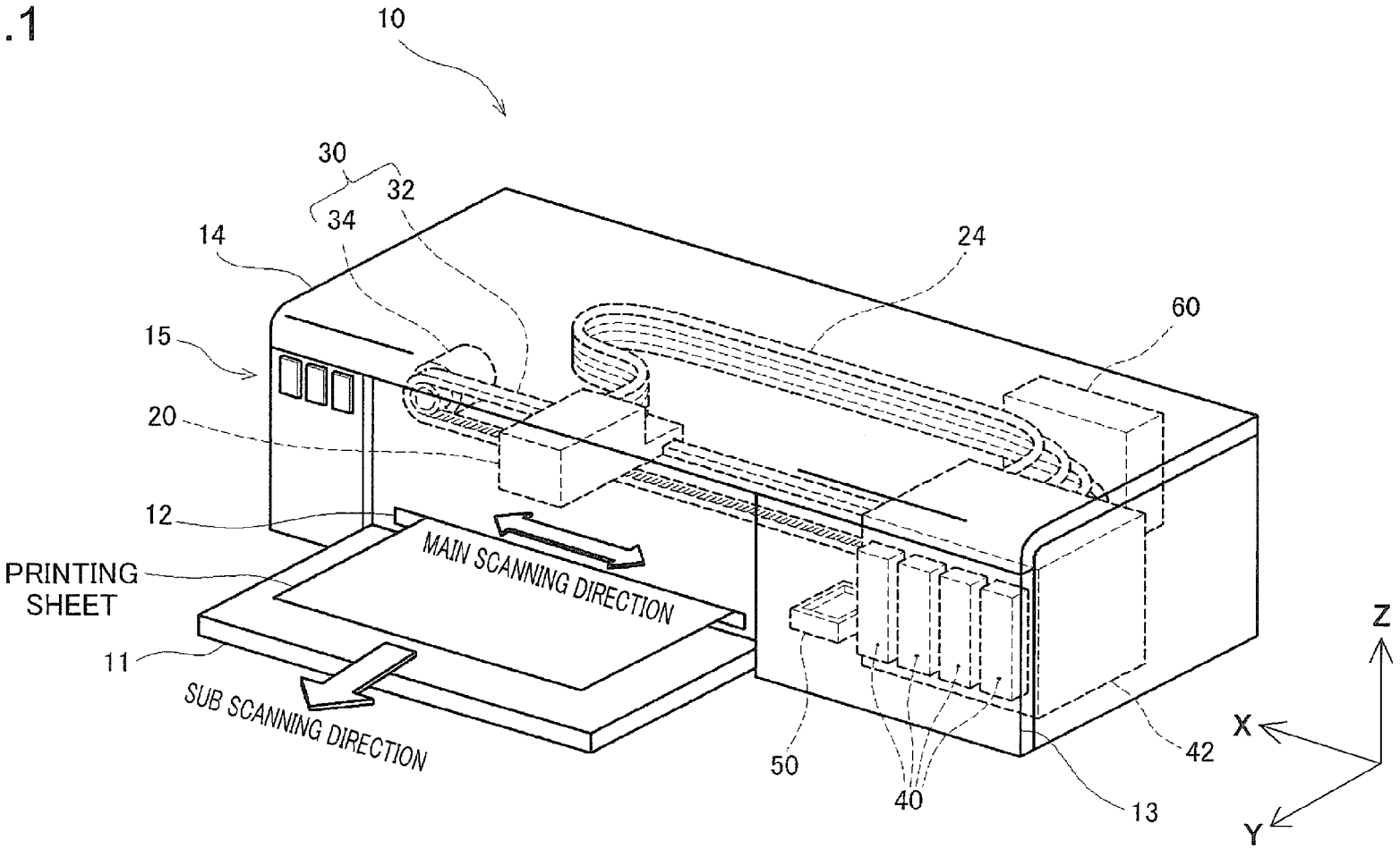
FIG. 1 schematically illustrates the structure of a printing device.

FIG. 1 illustrates the general structure of an inkjet printing device according to one embodiment of the invention. XYZ axes orthogonal to one another are shown in FIG. 1. The XYZ axes in FIG. 1 correspond to the XYZ axes in the other drawings. In the subsequent drawings, the XYZ axes are shown according to the requirements. According to this embodiment, in the use attitude of a printing device 10, the Z axis represents the vertical direction (direction of gravity), the Y axis represents the direction of attachment and detachment of cartridges 40 to and from a cartridge holder 42, and the X axis represents the alignment direction of a plurality of the cartridges 40. More specifically, the +Z-axis direction represents the vertically upward direction, the −Z-axis direction represents the vertically downward direction, the +Y-axis direction represents the pull-out direction of the cartridges 40, the −Y-axis direction represents the insertion direction of the cartridges 40, the +X-axis direction represents the direction of a surface of the cartridge 40, on which a predetermined label 79 (FIG. 3) is applied, and −X-axis direction represents the direction of its rear face. In the description hereinafter, the +Z-axis direction and the −Z-axis direction may respectively be called upward and downward, and the +Y-axis direction and the −Y-axis direction may respectively be called forward (front side) and backward (rearward, back side).

The printing device 10 shown in FIG. 1 is in a substantially box-like shape appearance and has a front cover 11 provided on the approximate center of the front face and a plurality of operation buttons 15 provided on its left side. The front cover 11 is supported on its lower end, so that pulling down its upper end causes a paper discharge slot 12, from which printing sheets are discharged, to appear. A paper feed tray (not shown) is provided on the back side of the printing device 10. When the user sets printing sheets in the paper feed tray and operates a relevant operation button 15, each printing sheet is fed from the paper feed tray, is subjected to printing, for example, images on its surface inside the printing device 10 and is then discharged from the paper discharge slot 12.

A top cover 14 is provided on the top face of the printing device 10. The top cover 14 is supported on its back side, so that lifting up its front side to open the top cover 14 allows checking the internal state of the printing device 10 or maintaining or repairing the printing device 10.

The printing device 10 includes a jet head 20 serving to form ink dots on the printing sheet while moving back and forth in a main scanning direction, and a drive mechanism 30 serving to move the jet head 20 back and forth. A plurality of jet nozzles are provided on the bottom face of the jet head 20 (i.e., the face opposed to the printing sheet), and ink is ejected from the jet nozzles onto the printing sheet.

Ink to be ejected from the jet nozzles is contained in a liquid container called the cartridge 40. The cartridge 40 is attached to the cartridge holder 42 provided at a different location from the jet head 20, and the ink in the cartridge 40 is supplied through an ink tube 24 to the jet head 20. In the printing device 10 of this embodiment, a cartridge replacement cover 13 supported on its lower end is provided on the right side of the front cover 11. Pulling down the upper end of the cartridge replacement cover 13 allows for attachment and detachment of the cartridges 40.

The illustrated printing device 10 is capable of printing a color image with four different color inks, i.e., cyan, magenta, yellow and black. Jet nozzles for the respective color inks are correspondingly provided on the jet head 20. The ink in the cartridge 40 of the corresponding color ink is supplied to the jet nozzles of the corresponding color ink via a corresponding ink tube 24 provided for each color ink.

The drive mechanism 30 adapted to move the jet head 20 back and forth has a timing belt 32 with a plurality of teeth formed inward and a drive motor 34 provided to drive the timing belt 32. Part of the timing belt 32 is fixed to the jet head 20. The jet head 20 is moved back and forth in the main scanning direction by driving the timing belt 32, while being guided by a guide rail (not shown) extended in the main scanning direction.

A region called home position is provided at a position outside a printing area, to which the jet head 20 is moved in the main scanning direction. A maintenance mechanism is provided at the home position. The maintenance mechanism includes a cap 50 to be pressed against the bottom face of the jet head 20 with the jet nozzles (nozzle surface) to form a closed space surrounding the jet nozzles, a lift mechanism (not shown) adapted to lift up and clown the cap 50 to be pressed against the nozzle surface of the jet head 20, and a suction pump (not shown) adapted to apply a negative pressure to the closed space formed by pressing the cap 50 against the nozzle surface of the jet head 20.

Additionally, the printing device 10 further includes a paper feed mechanism (not shown) adapted to feed printing sheets and a controller 60 adapted to control the operations of the whole printing device 10. The operation of moving back and forth the jet head 20, the operation of feeding printing sheets, the operation of ejecting ink from the jet nozzles, and the maintenance operation to ensure normal printing are all controlled by the controller 60.

Figure 2:
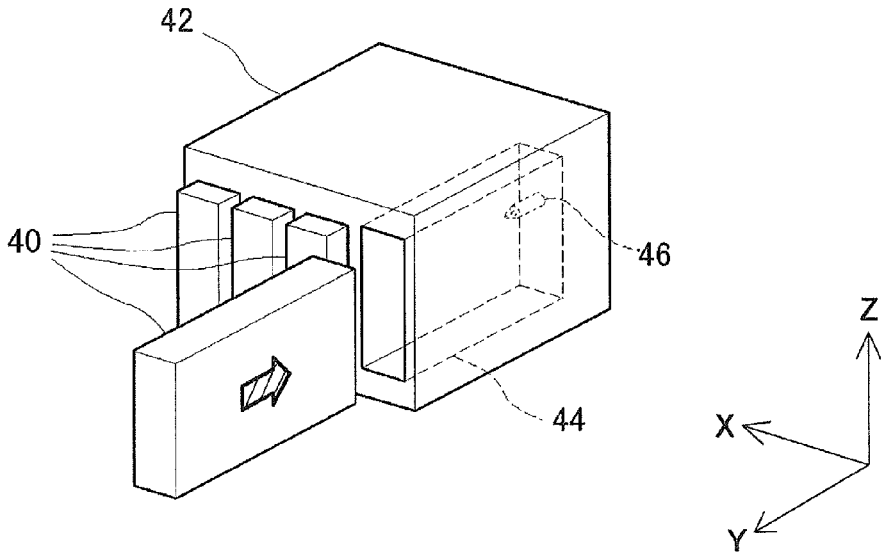
FIG. 2 illustrates attaching of a cartridge to a cartridge holder.

FIG. 2 illustrates attaching the cartridge 40 to the cartridge holder 42. The cartridge holder 42 has slots 44 provided for the respective cartridges 40, such that the cartridge 40 is inserted from the +Y-axis direction to the −Y-axis direction into the slot 44. A −Y-axis direction face of the slot 44 has a liquid supply tube 46 extended in the +Y-axis direction to receive ink from the cartridge 40. A −Y-axis direction face of the cartridge 40 has an ink supply port (not shown). When the cartridge 40 is inserted into and set in the slot 44 of the cartridge holder 42, the liquid supply tube 46 is inserted into the ink supply port to allow the ink in the cartridge 40 to enter the printing device 10.

The cartridge holder 42 includes ink paths and diaphragm pumps (not shown). The ink entering from the liquid supply tube 46 flows through the ink path into the ink tube 24 (FIG. 1) connected with the rear side of the cartridge holder 42. The diaphragm pump provided on the ink path sucks ink in the cartridge 40 and pressure-feeds the ink toward the jet head 20. As explained above, the printing device 10 of the embodiment has the cartridges 40 of the four different color inks, cyan, magenta, yellow and black and the inks in these cartridges 40 are independently supplied to the jet head 20. Ink paths and diaphragm pumps are thus correspondingly provided in the cartridge holder 42 for the respective cartridges 40.

Figure 3:
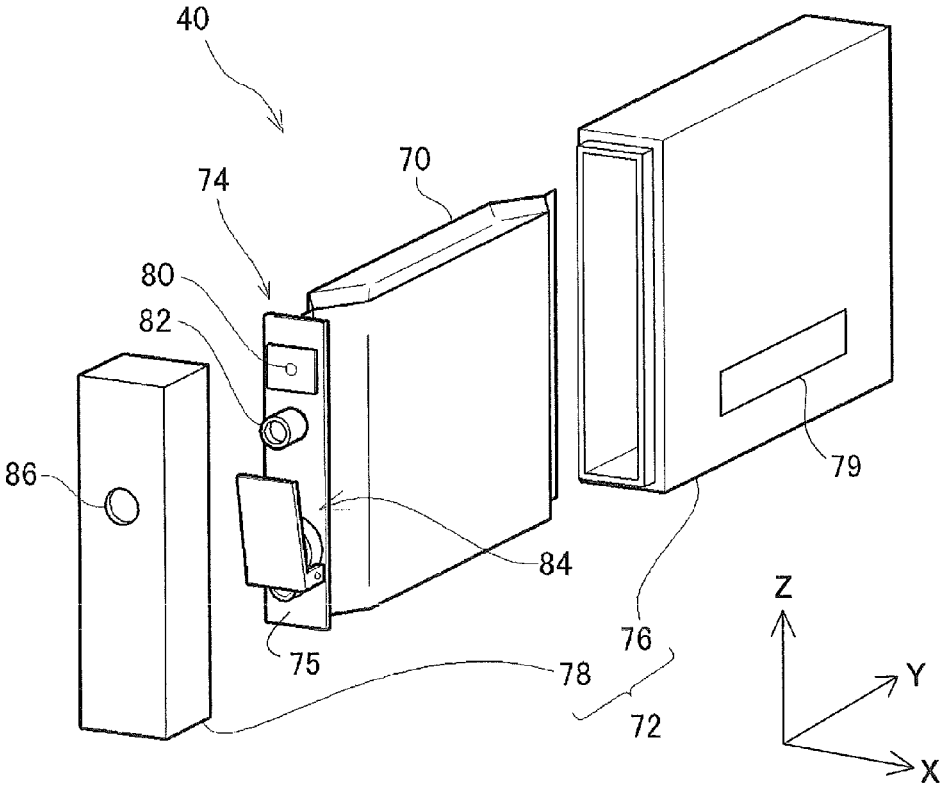
FIG. 3 is an exploded perspective view illustrating the structure of the cartridge.

FIG. 3 is an exploded perspective view illustrating the structure of the cartridge 40 according to the embodiment. The cartridge 40 includes an ink pack 70 serving as a liquid container to contain ink, a cartridge casing 72, in which the ink pack 70 is accommodated, and an ink supply member 74. The ink pack 70 is in an approximately rectangular shape viewed from the X-axis direction and has the ink supply member 74 provided on the −Y-axis direction side. A −Y-axis direction surface 75 of the ink supply member 74 includes an ink filler port 80 provided to fill ink into the ink pack 70, an ink supply port 82, into which the liquid supply tube 46 provided in the cartridge holder 42 is inserted, and an ink detector 84 adapted to detect the state of remaining ink in the ink pack 70. The detailed structure of the ink detector 84 will be described later.

The cartridge casing 72, in which the ink pack 70 is accommodated, includes a main body casing 76 and a cover casing 78. The main body casing 76 in a box-like shape is capable of accommodating the ink pack 70 and has the predetermined label 79 applied on its +X-axis direction face. The cover casing 78 serves as a member to seal (cover) an opening of the main body casing 76 on its −Y-axis direction end. The main body casing 76 and the cover casing 78 are integrated together by fitting the cover casing 78 into the opening of the main body casing 76. A −Y-axis direction face of the cover casing 78 has a supply port aperture 86. When the cover casing 78 seals the opening of the main body casing 76, a −Y-axis direction end face of the ink supply port 82 is exposed through the supply port aperture 86.

Figure 4:
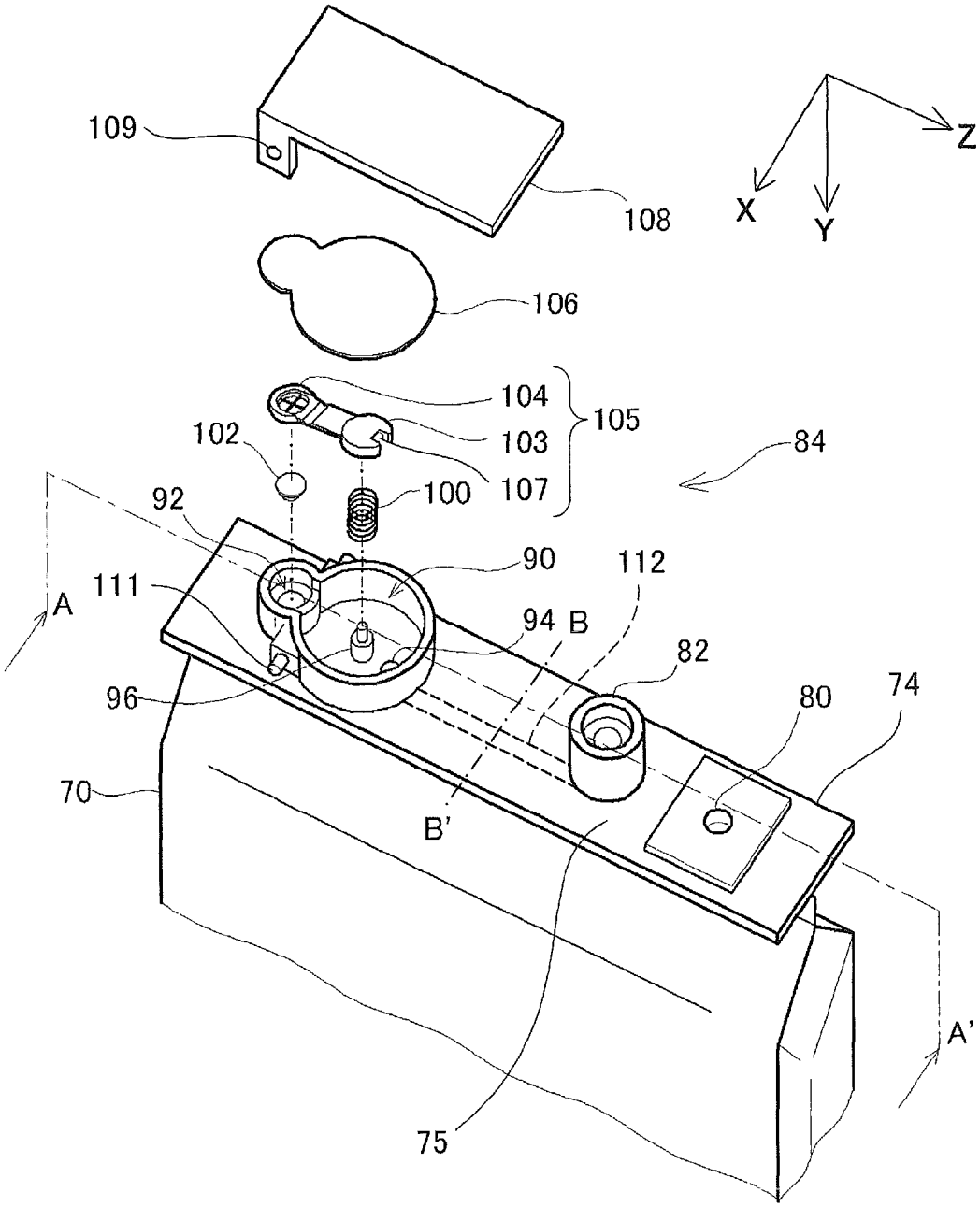
FIG. 4 is an exploded perspective view illustrating the detailed structure of an ink supply member and an ink detector.

FIG. 4 is an exploded perspective view illustrating the detailed structure of the ink supply member 74 and the ink detector 84. The ink supply member 74 is viewed from the −Y-axis direction in FIG. 4. The ink supply member 74 has the flat surface 75 in an approximately rectangular shape on the −Y-axis direction side. The ink filler port 80, the ink supply port 82, the ink detector 84 and a connection port 92 communicating with inside of the ink pack 70 are provided along the longitudinal direction on this surface 75. More specifically, the ink supply port 82 and the ink filler port 80 are arranged on the surface 75 on the +Z-axis direction side relative to the center shown by B-B' line in FIG. 4. According to this embodiment, the ink filler port 80 is provided on the +Z-axis direction side relative to the ink supply port 82. The connection port 92 is arranged on the surface 75 on the −Z-axis direction side relative to the center shown by the B-B' line in FIG. 4. The ink detector 84 is located between the connection port 92 and the ink supply port 82 and is arranged on the −Z-axis direction side relative to the center shown by the B-B line according to this embodiment. The ink filler port 80, the ink supply port 82 and the connection port 92 are provided to face in the −Y-axis direction. The ink supply member 74 includes a flow path 112 provided to connect the connection port 92 with the ink supply port 82 via the ink detector 84. The flow path 112 is provided on the rear face of the ink supply member 74 in this embodiment, but may be provided on the surface 75 of the ink supply member 74.

The ink detector 84 includes an ink detection chamber 90 in an approximately cylindrical shape, which is filled with ink from the ink pack 70, various parts kept in the ink detection chamber 90, a flexible film 106 provided to seal an opening of the ink detection chamber 90 on its −Y-axis direction end face while keeping the various parts in the ink detection chamber 90, and a lever member 108 provided to come into contact with the outer face of the film 106. The film 106 corresponds to the "variable element" according to the invention.

In the cartridge 40 according to the embodiment, the ink in the ink pack 70 flows through the ink detection chamber 90 and the flow path 112 and flows out of the ink supply port 82. Correspondingly the ink detection chamber 90 has the connection port 92 provided to communicate with the ink pack 70 and receive the inflow of the ink from the ink pack 70, and an outflow port 94, through which the ink in the ink detection chamber 90 flows out to the ink supply port 82 via the flow path 112. The outflow port 94 is provided on the bottom of the ink detection chamber 90 on the +Y-axis direction side in this embodiment, but may be provided on the side wall of the ink detection chamber 90 on the +Z-axis direction side.

The ink detection chamber 90 includes a check valve 102 provided to prevent the back flow of ink from the ink detection chamber 90 into the ink pack 70 through the connection port 92, a spring 100 provided to press the film 106 outward from inside of the ink detection chamber 90, and a pressure-receiving member 105 located between the check valve 102 with the spring 100 and the film 106. The spring 100 corresponds to the "pressing member" according to the invention.

The pressure-receiving member 105 includes an approximately circular travel limiter 104 and an approximately circular spring-receiving element 103, which are coupled with each other across a predetermined interval. The travel limiter 104 restricts the check valve 102 from moving to the downstream of the connection port 92, i.e., into the ink detection chamber 90, while allowing the inflow of the ink through the connection port 92 into the ink detection chamber 90. The spring 100 is located between the spring-receiving element 103 and a projection 96 protruded from the bottom face of the ink detection chamber 90 (i.e., +Y-axis direction face) toward the −Y-axis direction. The spring-receiving element 103 has a concaved face abutting the spring 100 (i.e., +Y-axis direction face) and a cutout 107 extended from the vicinity of the center toward the outer periphery of the spring-receiving element 103. The travel limiter 104 and the spring-receiving element 103 are provided as the coupled single member according to this embodiment, but may be provided as separate members. The cutout 107 may be omitted.

When the pressure-receiving member 105 is placed in the ink detection chamber 90, the check valve 102 is located between the travel limiter 104 and the connection port 92. This positioning restricts the motion of the check valve 102 into the ink detection chamber 90. A −Y-axis direction end of the spring 100 is fixed in the concaved rear face of the spring-receiving element 103, so that the spring 100 is positioned between the concaved face and the projection 96 in the ink detection chamber 90.

The lever member 108 is provided on the −Y-axis direction side of the ink detection chamber 90 sealed with the film 106. Inserting a projection 111 provided on the outer face of the ink detection chamber 90 into a fitting aperture 109 provided at a −Z-axis direction end of the lever member 108 enables the lever member 108 to be supported in a rotatable manner around the position of the fitting aperture 109.

Figure 5:
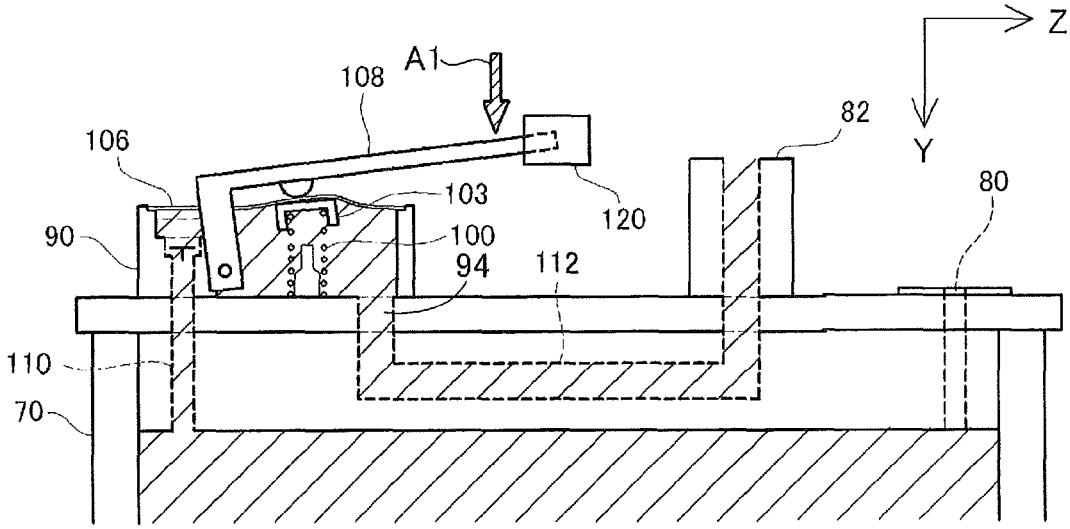
FIG. 5 illustrates mechanism of the ink detector to detect absence of ink in an ink pack.
Figure 6:
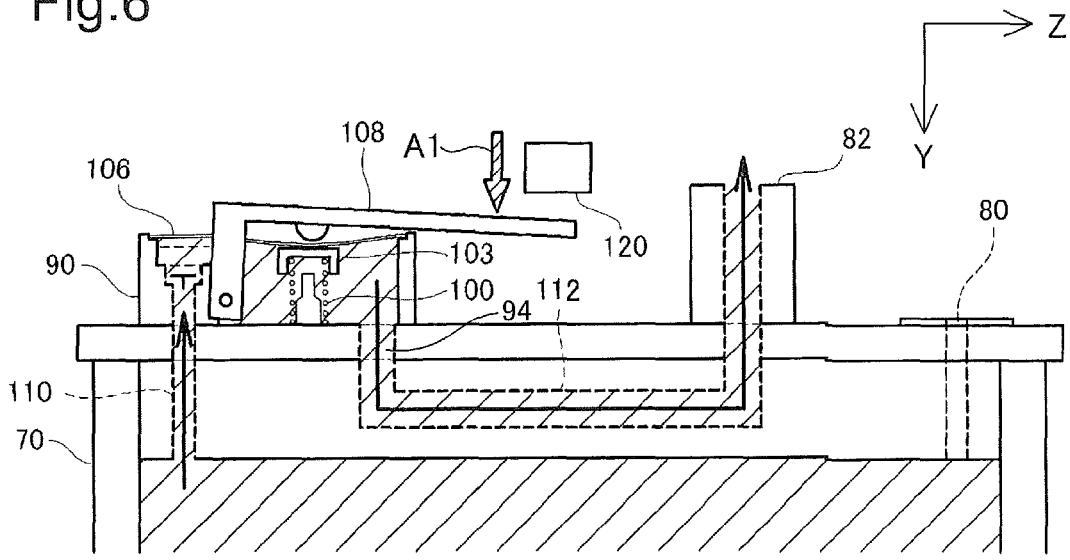
FIG. 6 illustrates the mechanism of the ink detector to detect absence of ink in the ink pack.

FIGS. 5 and 6 illustrate a mechanism of the ink detector 84 to detect the absence of ink in the ink pack 70. FIGS. 5 and 6 show the YZ cross section along A-A' line going through the center of the ink detection chamber 90 in FIG. 4, viewed from the +X-axis direction. FIG. 5 shows the state of the ink detector 84 that ink is not sucked out of the ink supply port 82, whilst FIG. 6 shows the state of the ink detector 84 that ink is sucked out of the ink supply port 82. In the embodiment shown in FIGS. 5 and 6, the flow path 112 connecting the ink detection chamber 90 with the ink supply port 82 is extended from the outflow port 94 in the ink detection chamber 90 in an opposite direction (+Y-axis direction) to the extended direction of the ink supply port 82 (−Y-axis direction), is bent at right angles in the +Z-axis direction, is further bent at right angles in the −Y-axis direction and is connected to the ink supply port 82.

In the state of FIG. 5 that ink is not sucked out of the ink supply port 82, the spring 100 in the ink detection chamber 90 presses the spring-receiving element 103 in the −Y-axis direction, so that the film 106 at the location abutting the spring-receiving element 103 is deformed to apply the force of pushing the lever member 108 outward in the −Y-axis direction.

The force of pushing back the lever member 108 in the +Y-axis direction by a pressing mechanism (not shown) is applied to the lever member 108 from outside of the lever member 108. In the drawing, an arrow A1 represents the direction of the force applied to the lever member 108 by the pressing mechanism. The lever member 108 is maintained in the state slightly pushed outward in the −Y-axis direction with the forces in the opposite directions applied on the lever member 108 balancing with each other, as shown in FIG. 5.

In the cartridge 40 according to the embodiment, the diameter of a flow path 110 connecting the ink detection chamber 90 with the ink pack 70 is greater than the diameter of the flow path 112 connecting the ink detection chamber 90 with the ink supply port 82. Sucking ink through the ink supply port 82 to supply ink into the jet head 20 makes inside of the ink detection chamber 90 in the negative pressure. In this state, the film 106 is deformed inward to the ink detection chamber 90 by the negative pressure, so that the lever member 108 is pushed down in the +Y-axis direction by the pressing mechanism (not shown), as shown in FIG. 6.

When the ink remains in the ink pack 70, the subsequent supply of ink into the ink detection chamber 90 returns the pressure to the original level in the ink detection chamber 90. The film 106 is accordingly returned to its original state (state of FIG. 5), after elapse of a predetermined time period since suction of ink out of the ink supply port 82. The lever member 108 is thus pushed outward again by the spring-receiving element 103. In this state, the lever member 108 is detected by a photosensor 120 provided at a peripheral end of the lever member 108 after elapse of the predetermined time period since suction of ink. This leads to the estimation that the volume of ink of or above a preset level still remains in the ink pack 70. According to this embodiment, the photosensor 120 is provided inside the cartridge 40 to detect the motion of the lever member 108.

When the volume of ink in the ink pack 70 decreases to be less than the preset level, on the other hand, there is no supply of the volume of ink corresponding to the outflow from the ink detection chamber 90 to the ink detection chamber 90. The lever member 108 is thus kept down by the pressing mechanism (not shown). In this state, the lever member 108 is not detected by the photosensor 120 even after elapse of the predetermined time period since suction of ink out of the ink supply port 82. This leads to the estimation that the volume of ink in the ink pack 70 decreases to be less than the preset level. As described above, the ink detector 84 according to this embodiment detects a pressure change in the ink detection chamber 90 as the positional change of the spring-receiving element 103 (and the corresponding positional change of the lever member 108), so as to detect the state of remaining ink in the ink pack 70.

As described previously, the ink detection chamber 90 of the ink detector 84 according to this embodiment has the very narrow inner space, so that air bubbles may remain in the ink detection chamber 90 when ink is filled into the ink detection chamber 90 for the first time (at the initial filling time). The spring-receiving element 103 is concaved at the position where the spring 100 abuts the spring-receiving element 103 (FIG. 4), so that it is generally difficult to expel the air bubbles from this concaved position.

As described above, however, in the ink detector 84 of the embodiment, the spring-receiving element 103 of the pressure-receiving member 105 in the ink detection chamber 90 is partly cut out (FIG. 4), which advantageously prevents air bubbles from remaining at the position where the spring 100 abuts the spring-receiving element 103.

Figure 7:
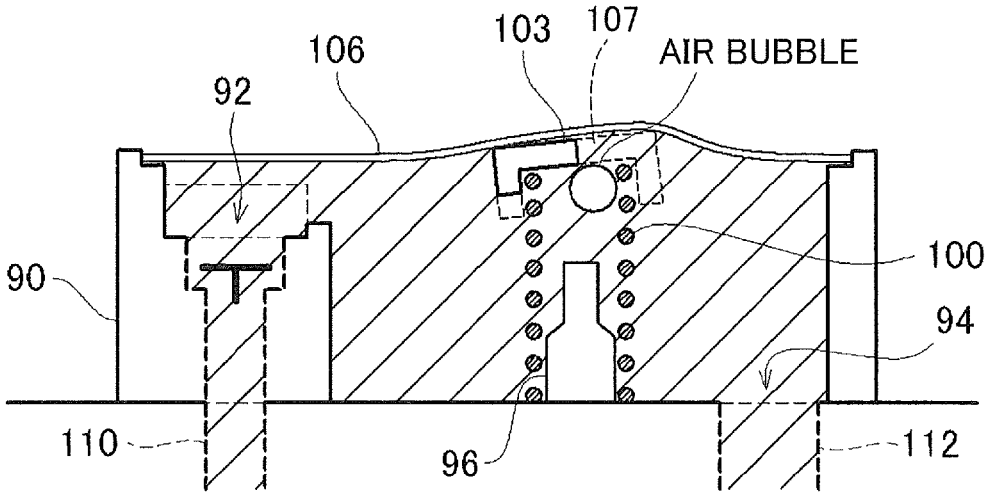
FIG. 7 illustrates reason to prevent air bubbles from being accumulated on a spring-receiving element.
Figure 8:
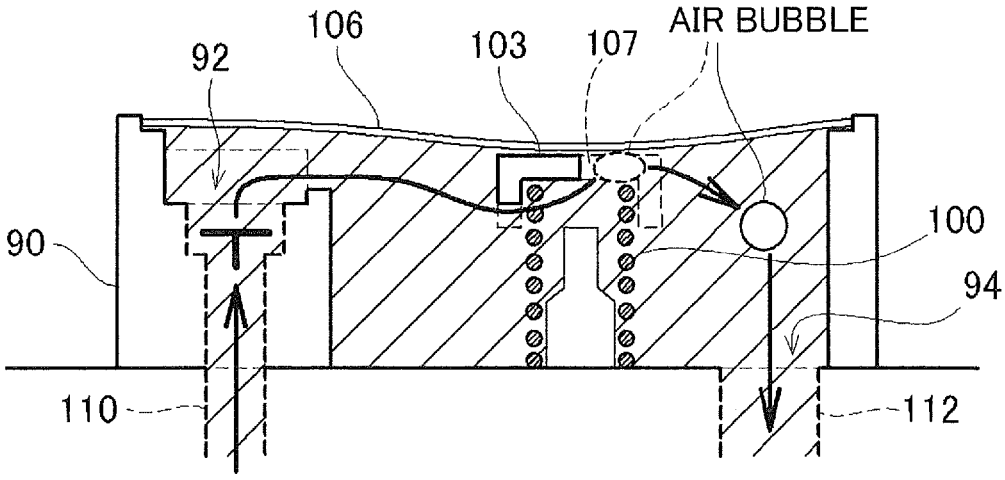
FIG. 8 illustrates the reason to prevent air bubbles from being accumulated on the spring-receiving element.

FIGS. 7 and 8 illustrate the reason to prevent air bubbles from being accumulated at the position where the spring-receiving element 103 abuts the spring 100 in the ink detector according to this embodiment. FIGS. 7 and 8 are the close-up views showing the YZ cross section of the ink detection chamber 90 shown in FIGS. 5 and 6.

As described above, the spring-receiving element 103 of the embodiment is a disk-shaped member having the concaved face abutting the spring 100 and has the cutout 107 extended from inside of the disk toward its outer periphery. This arrangement forms a passage of the depth corresponding to the thickness of the spring-receiving element 103, from inside to outside of the abutting face where the spring-receiving element 103 abuts the spring 100 as shown in FIG. 7.

The extended direction of the cutout 107 in the spring-receiving element 103 is substantially identical with the direction of the ink flow (+Z-axis direction) from the connection port 92 to the outflow port 94 in the ink detection chamber 90. This direction is also identical with the direction from the base end to the peripheral end of the lever member 108 attached to the ink detection chamber 90 (i.e., the direction from the travel limiter 104 toward the spring-receiving element 103 of the pressure-receiving member 105). As shown in FIG. 8, part of the ink flow moving from the connection port 92 to the outflow port 94 flows along the abutting face where the spring-receiving element 103 abuts the spring 100 to pass through the cutout 107 of the spring-receiving element 103 and move out of the spring-receiving element 103 to the outflow port 94. This expels the air bubbles accumulated on the abutting face where the spring-receiving element 103 abuts the spring 100, out of the spring-receiving element 103 and subsequently to the upstream of the ink detection chamber 90 through the outflow port 94.

The ink detector 84 of the embodiment having the spring-receiving element 103 arranged as described above can expel the air bubbles accumulated at the position where the spring-receiving element 103 abuts the spring 100, out of the spring-receiving element 103. This prevents air bubbles from being accumulated in the ink detection chamber 90 and thereby prevents the air bubbles from affecting the pressure change in the ink detection chamber 90. This moves the spring-receiving element 103 in the mode adequately reflecting the pressure change in the ink detection chamber 90, thus enabling the state of remaining ink in the ink pack 70 to be adequately detected.

As described above, the spring-receiving element 103 is cut out in the direction substantially identical with the direction of the ink flow in the ink detection chamber 90 (FIG. 8). This prevents the ink flow in the ink detection chamber 90 from being interrupted at the position of the spring-receiving element 103. This arrangement facilitates suction of ink from the cartridge 40 and thereby relieves the load imposed on the pump (diaphragm pump in the embodiment) used to suck the ink through the ink supply port 82 to the cartridge holder 42.

Additionally, the cutout 107 provided in the spring-receiving element 103 allows checking whether the spring 100 is set in the spring-receiving element 103, while the pressure-receiving member 105 is mounted on the ink detection chamber 90, during assembly of the ink detector 84 in the manufacturing process of the cartridge 40. This enables the manufacturer to readily find no attachment of the spring 100, thus reducing the defective of the cartridge 40.

The ink supply port 82 and the ink filler port 80 are provided on the surface 75 of the ink supply member 74 included in the cartridge 40 of the embodiment to be arranged on the +Z-axis direction side along the longitudinal direction relative to the center shown by the B-B' line in FIG. 4. This arrangement allows air bubbles to be efficiently expelled out of the ink pack 70 according to a manufacturing method of the cartridge 40 described below. The connection port 92 communicating with the ink pack 70 is provided on the ink supply member 74 to be arranged on the −Z-axis direction side along the longitudinal direction relative to the center shown by the B-B' line in FIG. 4. In the use attitude of this cartridge 40, the connection port 92 communicates with the lower-most portion of the ink pack 70, thus allowing thorough and efficient consumption of ink.

B. Manufacturing Method

Figure 9:
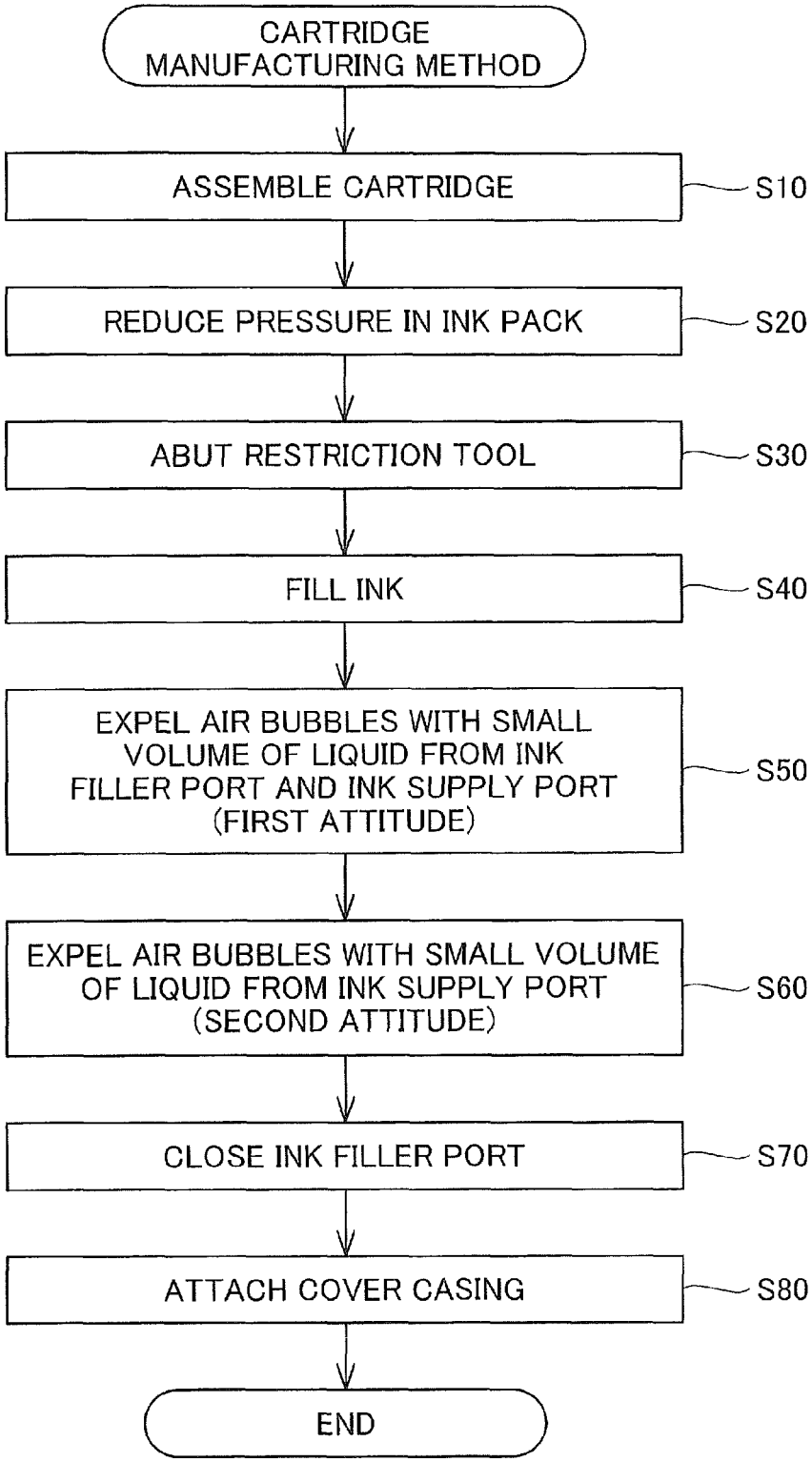
FIG. 9 is a flowchart showing a manufacturing method of the cartridge.

FIG. 9 is a flowchart showing the manufacturing method of the cartridge 40. The cartridge 40 is eventually filled with 1000 ml of ink according to this manufacturing method of the embodiment. The manufacturing method of the embodiment first assembles the cartridge 40 (step S10). More specifically, the manufacturing method assembles the ink detector 84 on the surface 75 of the ink supply member 74 and subsequently thermally welds or otherwise fixes one opening side 71 (FIG. 10) of the vacant ink pack 70 to the ink supply member 74, such that the ink filler port 80 and the connection port 92 communicate with inside of the ink pack 70. The ink supply member 74 is then attached to the main body casing 76, so that the ink pack 70 is placed in the main body casing 76. The cover casing 78 (FIG. 3) is attached in the final step of this manufacturing method.

Figure 10:
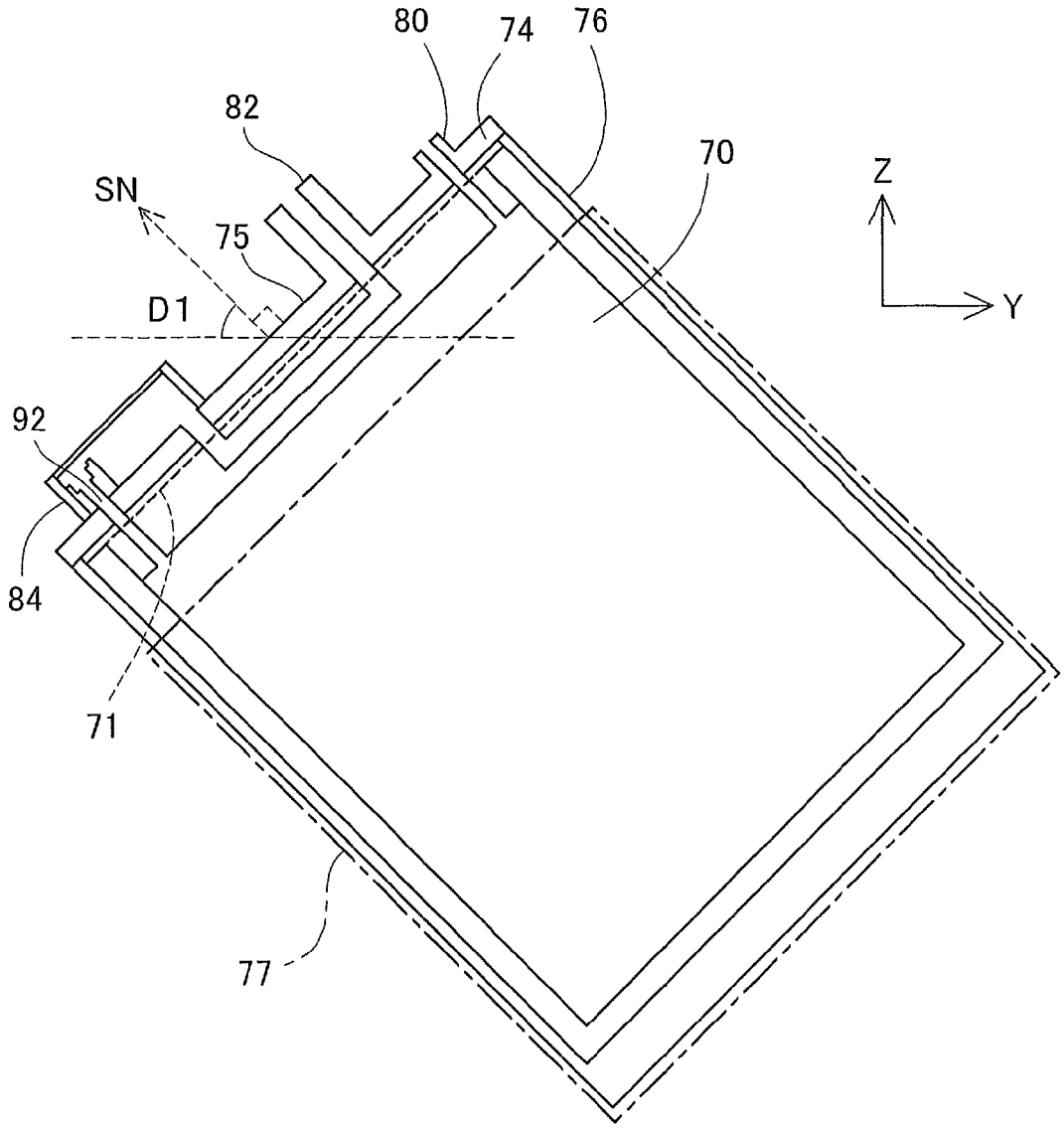
FIG. 10 schematically illustrates the ZY cross section of the cartridge.

FIG. 10 schematically illustrates the ZY cross section of the cartridge 40 assembled at step S10. The cartridge 40 is inclined at a predetermined angle to the Y axis in FIG. 10. More specifically, the cartridge 40 illustrated in FIG. 10 is in the attitude that the ink filler port 80 is located above (on the +Z-axis direction side of) the connection port 92 in the vertical direction, and that a surface normal vector SN of the surface 75 of the ink supply member 74 is inclined at a predetermined angle D1 upward (on the +Z-axis direction side) from the horizontal surface (XY plane in this embodiment). In the description below, the attitude of the cartridge 40 shown in FIG. 10 is called "first attitude". In the first attitude, the angle D1 is not less than +1 degree and is less than +90 degrees and is preferably not less than +5 degrees and is not greater than +85 degrees.

After assembling the cartridge 40, the manufacturing method sets the cartridge 40 in the first attitude shown in FIG. 10 and reduces the pressure in the ink pack 70 (step S20). More specifically, the manufacturing method connects the pump to both the ink filler port 80 and the ink supply port 82 to suck the air simultaneously from the two ports and thereby reduce the pressure. The pressure reduction may reduce the pressure from one of the ink filler port 80 and the ink supply port 82, while sealing the other. The pressure reduction may locate the whole cartridge 40 in the atmosphere of the reduced pressure. The operation of step S20 is performed in the first attitude shown in FIG. 10 according to this embodiment, but may be performed in another attitude (for example, second attitude described later). After reducing the pressure in the ink pack 70, the manufacturing method abuts a restriction tool 77 of the higher rigidity than that of the main body casing 76 against the +X-axis direction face and the −X-axis direction face of the cartridge 40 (step S30), while keeping the cartridge 40 in the first attitude shown in FIG. 10. This prevents the ink pack 70 from being excessively expanded in the most easily expandable X-axis direction during the ink filling operation at step S90 described below and enables the ink to reach to all the corners in the Z-axis direction and in the Y-axis direction. The restriction tool 77 may, for example, consist of two opposed metal plates, between which the cartridge 40 is inserted. The restriction tool 77 is in a box-like shape having one opening face or two opposed opening faces, through which the cartridge 40 is inserted. The operation of step S30 may be omitted. Additionally, the operation of step S30 may also be performed in another attitude (for example, second attitude described later), like the operation of step S20.

After abutting the restriction tool 77, the manufacturing method fills ink through the ink filler port 80 into the ink pack 70 in the reduced pressure (step S40), while keeping the cartridge 40 in the first attitude shown in FIG. 10. The method of this embodiment fills an excess volume of ink (for example, 1060 ml) exceeding the final ink volume (1000 ml) of the cartridge 40. According to this embodiment, ink is filled through the ink filler port 80, while the ink supply port 82 is closed. The operation of this step may also be performed in another attitude (for example, second attitude described later), like the operations of steps S20 and S30. This operation in the first attitude, however, enables ink to be efficiently filled into the ink pack 70 by means of the gravity. Additionally, the first attitude enables air bubbles to move to the upper-most portion in the +Z-axis direction of the ink pack 70 communicating with the ink filler port 80, while filling ink into the ink pack 70. This enables the air bubbles to be subsequently expelled (step S50) with higher efficiency.

After completion of ink filling, the manufacturing method drives the pump to expel the air bubbles entering the ink pack 70 from the ink filler port 80 and the ink supply port 82 during the ink filling operation (step S50), while keeping the cartridge 40 in the first attitude. According to this embodiment, a small volume of ink out of the ink filled at step S40 is expelled simultaneously with the air bubbles. Expelling ink simultaneously with air bubbles ensures efficient removal of the air bubbles. The manufacturing method of this embodiment may reduce the volume of ink in the ink pack 70, for example, from 1060 ml to 1030 ml at step S50.

Figure 11:
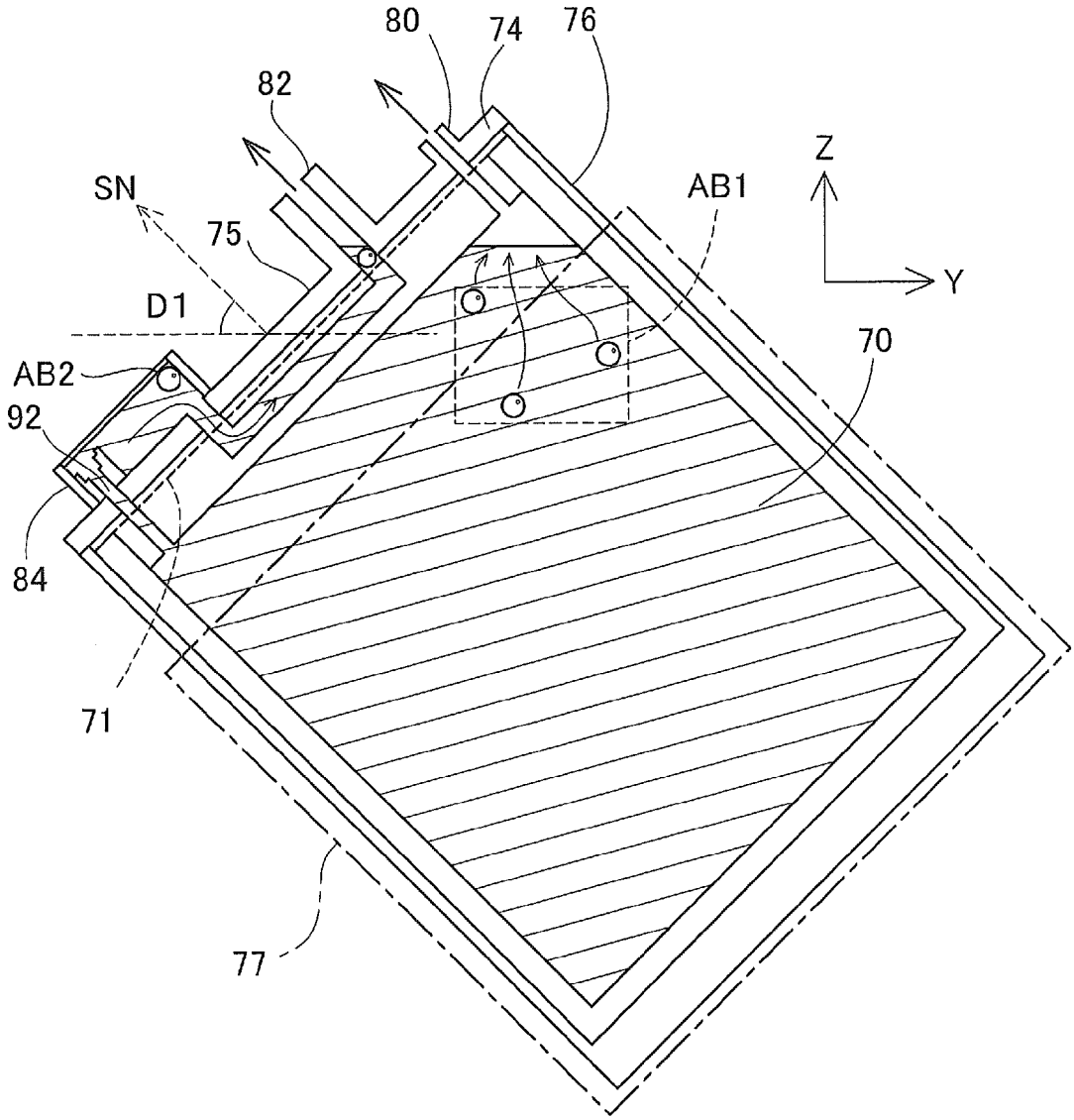
FIG. 11 illustrates expelling air bubbles out of the cartridge.

FIG. 11 illustrates expelling air bubbles out of the cartridge 40. As shown in FIG. 11, when the cartridge 40 is kept in the first attitude during removal of air bubbles at step S50, air bubbles AB1 in the ink pack 70 move to the upper-most portion in the +Z-axis direction of the ink pack 70 communicating with the ink filler port 80 by means of the buoyancy. This ensures efficient removal of air bubbles from the ink filler port 80. Simultaneously expelling air bubbles from the ink supply port 82 enables the air bubbles in the flow path from the connection port 92 located in the lower-most portion of the ink pack 70 to the ink supply port 82 to be simultaneously removed. According to this embodiment, the operation of step S40 is performed in the first attitude, so that most of air bubbles is expected to gather in the upper portion of the ink pack 70 on completion of step S40. In order to expel the air bubbles more fully, after completion of step S40, the manufacturing method may wait for a predetermined time period while keeping the cartridge 40 in the first attitude, before starting to expel the air bubbles at step S50. When the operation of step S40 is performed in another attitude instead of the first attitude, a preferable procedure of the manufacturing method may change the attitude of the cartridge 40 to the first attitude and subsequently wait for a predetermined time period until the air bubbles gather in the upper portion of the ink pack 70, before starting to expel the air bubbles at step S50.

After completion of expelling the air bubbles in the first attitude, the manufacturing method changes the attitude of the cartridge 40 to the second attitude and expels air bubbles again from the ink supply port 82 (step S60). Like the operation of step S50, a small volume of ink out of the ink filled at step S40 is simultaneously expelled with the air bubbles. Expelling ink simultaneously with air bubbles ensures efficient removal of the air bubbles. The manufacturing method of this embodiment may reduce the volume of ink in the ink pack 70, for example, from 1030 ml to 1000 ml, which is the expected final ink capacity of the cartridge 40, at step S60.

Figure 12:
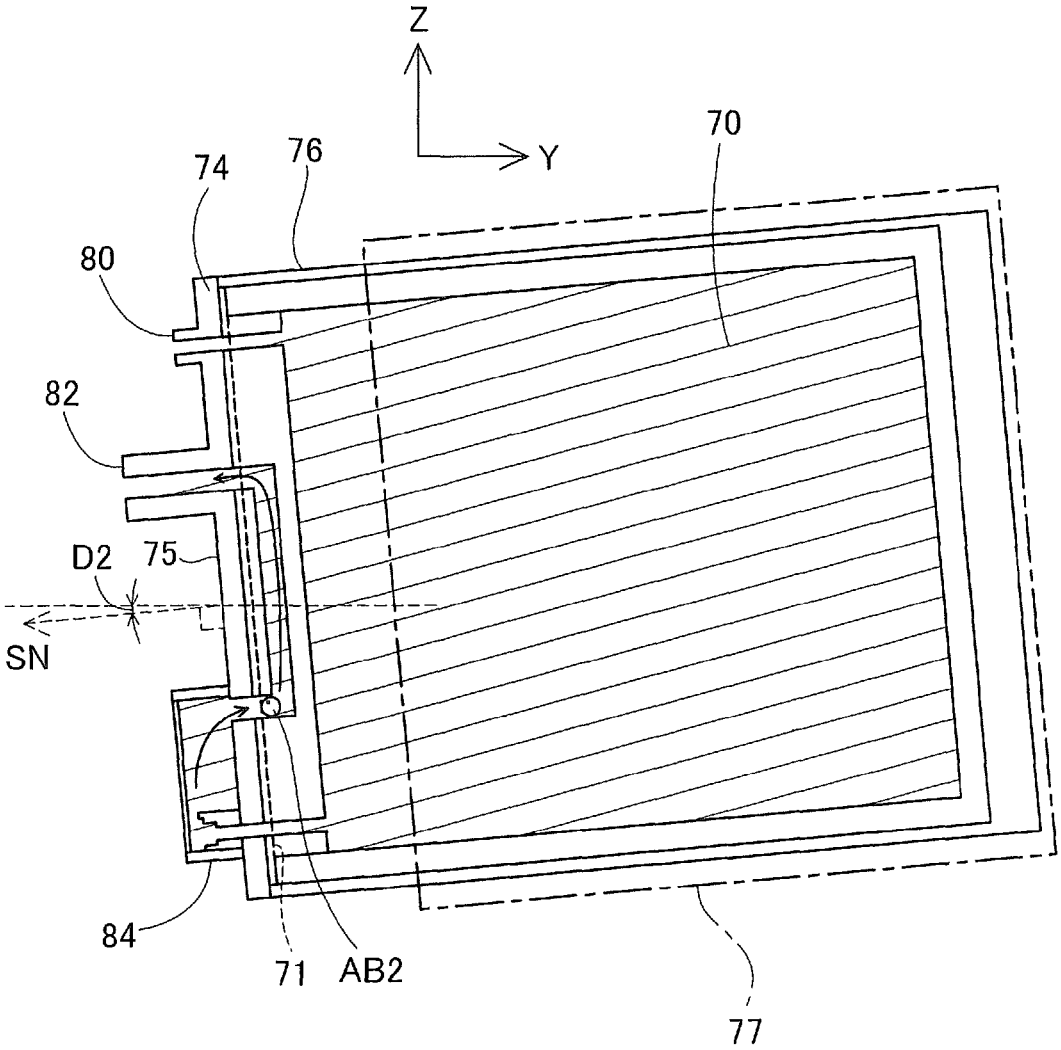
FIG. 12 illustrates the cartridge in a second attitude.

FIG. 12 illustrates the cartridge 40 in the second attitude. According to this embodiment, the "second attitude" represents the attitude that the ink filler port 80 is located above (on the +Z-axis direction side of) the connection port 92 in the vertical direction, and that the surface normal vector SN of the surface 75 of the ink supply member 74 is inclined at a predetermined angle D2 upward (on the +Z-axis direction side) from the horizontal surface (XY plane in this embodiment). According to this embodiment, the angle D2 is not less than −45 degrees and is less than +1 degree and is preferably not less than −40 degrees and is not greater than 0 degree.

Changing the attitude of the cartridge 40 from the first attitude to the second attitude facilitates removal of air bubbles (air bubbles AB2 shown in FIG. 11), which are not expelled but remain in the ink detector 84 in the first attitude, from the ink supply port 82 through the flow path 112 in the ink supply member 74. In the first attitude, the outflow port 94, through which ink flows out from the ink detection chamber 90 to the flow path 112, is arranged in the direction against the direction of buoyancy. The air bubbles AB2 are thus prone to be accumulated in the upper corner in the vertical direction in the ink detector 84. In the second attitude, however, the outflow port 94 viewed from inside of the ink detection chamber 90 is directed substantially horizontally or slightly upward (+Z-axis direction). This increases the possibility that the air bubbles AB2 flow out with the ink flow toward the ink supply port 82.

After expelling the air bubbles out of the ink pack 70 as described above, the manufacturing method closes the ink filler port 80 (step S70). According to this embodiment, the ink filler port 80 is closed by thermal caulking. Closing the ink filler port 80 is not limited to this method but may be, for example, a plug member made of a similar material to that of the ink supply member 74 may be welded to the ink filler port 80.

After closing the ink filler port 80, the manufacturing method attaches the cover casing 78 to the cartridge 40 to complete the cartridge 40.

According to the embodiment described above, in order to expel the air bubbles after ink filling, the manufacturing method of the cartridge 40 sets the cartridge 40 in the first attitude that the ink filler port 80 and the ink supply port 82 are directed obliquely upward from the horizontal axis (FIG. 10) to move the air bubbles entering the ink pack 70 toward the ink filler port 80 by means of the buoyancy. The air bubbles can thus be readily expelled out of the ink pack 70 through the ink filler port 80. The air bubbles are simultaneously expelled through the ink supply port 82. This ensures removal of the air bubbles in the flow paths 110 and 112 connecting the connection port 92 with the ink supply port 82 and in the ink detection chamber 90.

Additionally, after expelling air bubbles in the first attitude, the manufacturing method of the embodiment changes the attitude of the cartridge 40 to the second attitude that the ink filler port 80 and the ink supply port 82 are directed substantially horizontally or obliquely downward (FIG. 12). This allows the air bubbles in the ink detector 84 that are not expelled in the first attitude, to be smoothly expelled. According to this embodiment, the spring-receiving element 103 of the pressure-receiving member 105 has the cutout 107 as described above, so as to smoothly expel the air bubbles accumulated in between the spring-receiving element 103 and the spring 100.

The manufacturing method of the embodiment expels part of the initially filled ink together with the air bubbles in both the first attitude and the second attitude. This enables the air bubbles to be guided by the ink flow and smoothly expelled. Discharging part of the initially filled ink reserves a space in the cartridge casing 72, in which the ink pack 70 is freely movable. In an application that the ink pack 70 is filled with ink that needs pre-use stirring, the required stirring is easily achieved by simply shaking the cartridge 40. The manufacturing method of the embodiment fills ink after reducing the pressure in the ink pack 70. This facilitates the ink filling operation.

As described above, the manufacturing method of the cartridge 40 according to the embodiment effectively prevents air bubbles from remaining in the ink detector 84 as well as in the ink pack 70. The state of remaining ink in the cartridge 40 can thus be detected with high accuracy by the ink detector 84.

C. Another Embodiment

According to the above embodiment, the photosensor 120 used to detect the lever member 108 is provided inside the cartridge 40. According to another embodiment, the photosensor 120 may be provided on the cartridge holder 42.

Figure 13:
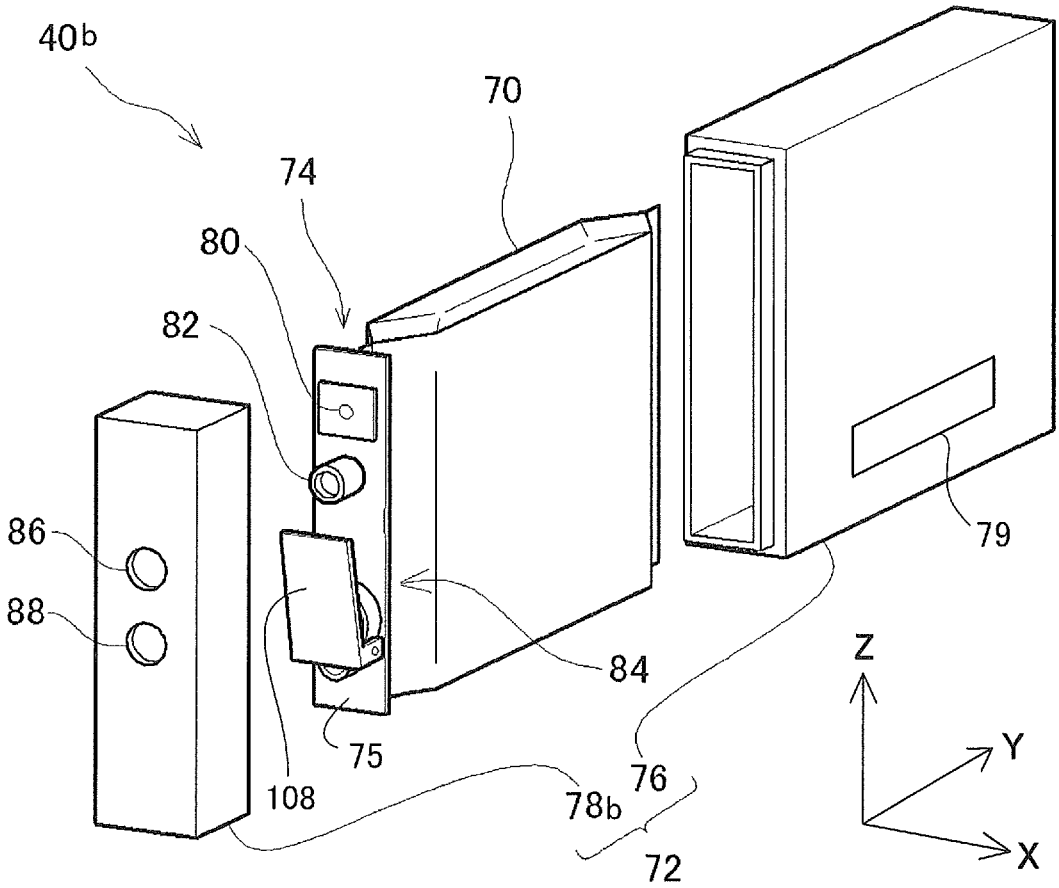
FIG. 13 illustrates a cartridge according to another embodiment, in which a photosensor is provided on the cartridge holder.

FIG. 13 illustrates a cartridge 40*b* according to another embodiment, in which the photosensor 120 is provided on the cartridge holder 42. As shown in FIG. 13, in the application that the photosensor 120 is provided on the cartridge holder 42, a cover casing 78*b* of the cartridge 40*b* has a sensor hole 88 at the position corresponding to the peripheral end (+Z-axis direction end) of the lever member 108 of the ink detector 84. A rod 48 shown in FIG. 14 is inserted through the sensor hole 88, when the cartridge 40 is attached to the cartridge holder 42.

Figure 14:
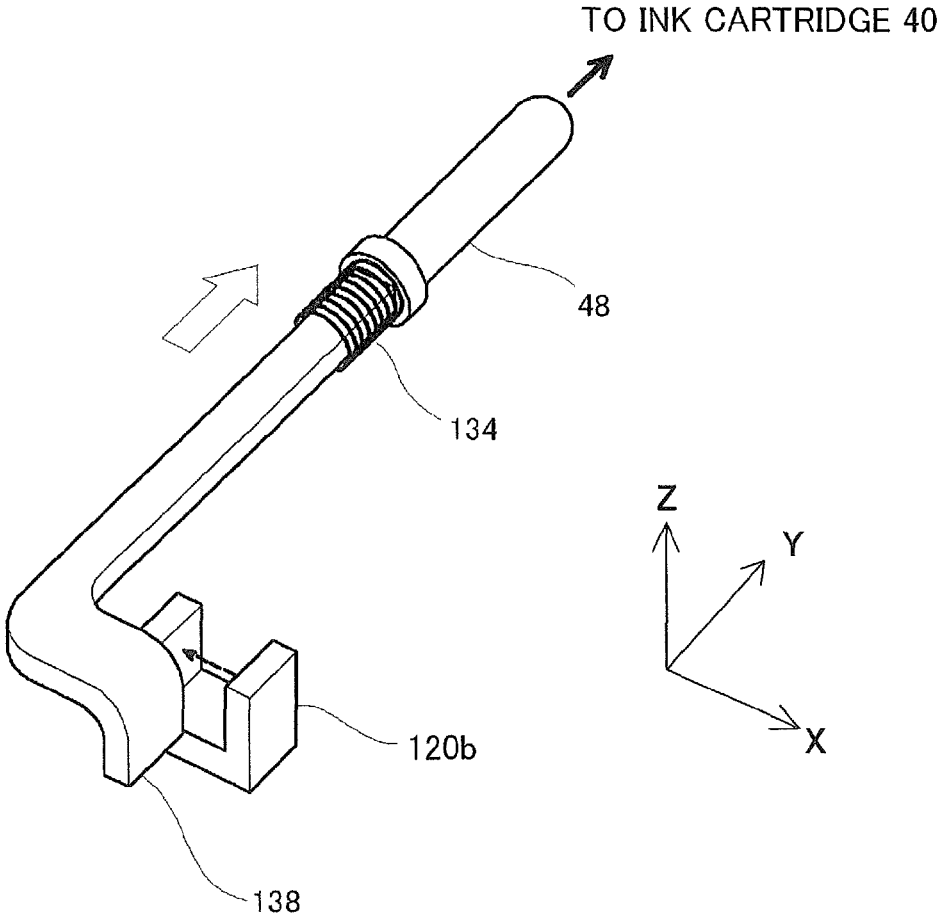
FIG. 14 is a perspective view illustrating the structure of a rod and the sensor provided on the cartridge holder.

FIG. 14 is a perspective view illustrating the structure of the rod 48 and a sensor 120*b* provided on the cartridge holder 42. The rod 48 and the sensor 120*b* illustrated in FIG. 14 are viewed from the back side (−Y-axis direction side) of the cartridge holder 42 shown in FIG. 2. As shown in FIG. 14, a spring 134 is set on the rod 48. The spring 134 presses the rod 48 in the +Y-axis direction toward the cartridge 40 to be attached to the cartridge holder 42.

This embodiment uses a transmissive photosensor in concaved shape for the photosensor 120*b*. This photosensor 120*b* has a light-emitting element and a light-receiving element (not shown) opposed to each other, such that the light-receiving element receives the light emitted from the light-emitting element. The illustrated broken-line arrow indicates the direction of light transmission.

A light shielding member 138 is provided at an opposite end (−Y-axis direction end) of the rod 48 opposite to the end facing the cartridge 40. When the rod 48 is moved toward the cartridge 40 (in the +Y-axis direction) by the force of the spring 134, the light shielding member 138 is inserted between the light-emitting element and the light-receiving element of the photosensor 120*b* to shield the light emitted from the light-emitting element. The light-receiving element of the photosensor 120*b* accordingly does not receive the light emitted from the light-emitting element and thereby detects a positional change of the rod 48. The photosensor 120*b* is the transmissive photosensor in this embodiment but may be any sensor that is capable of detecting a displacement of the rod 48.

Figure 15:
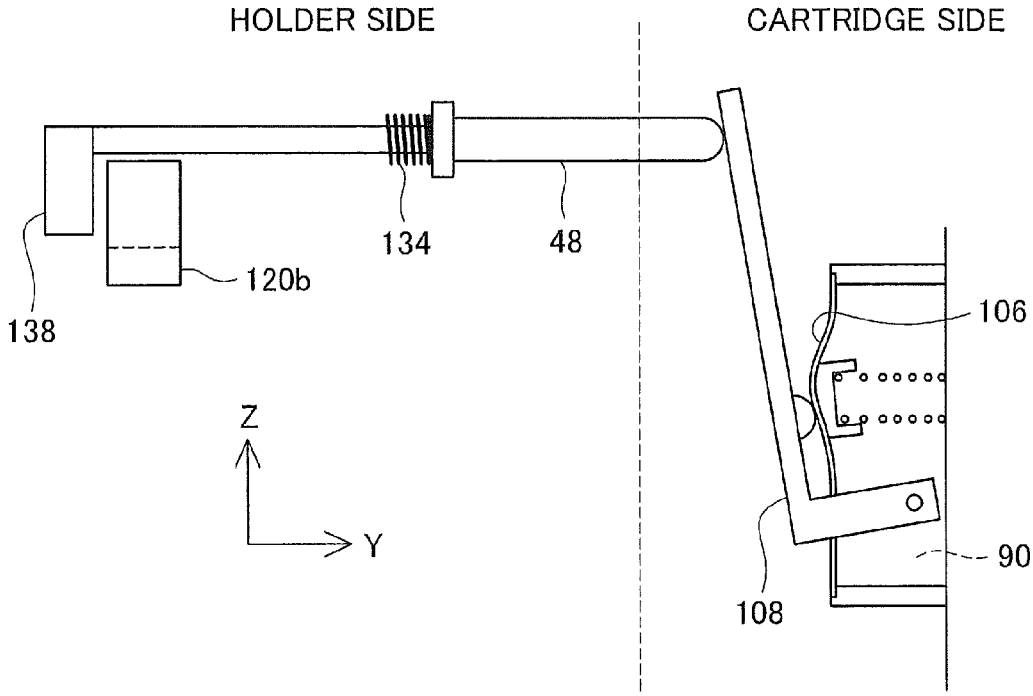
FIG. 15 shows detecting the presence or absence of ink by the sensor provided inside the cartridge holder.
Figure 16:
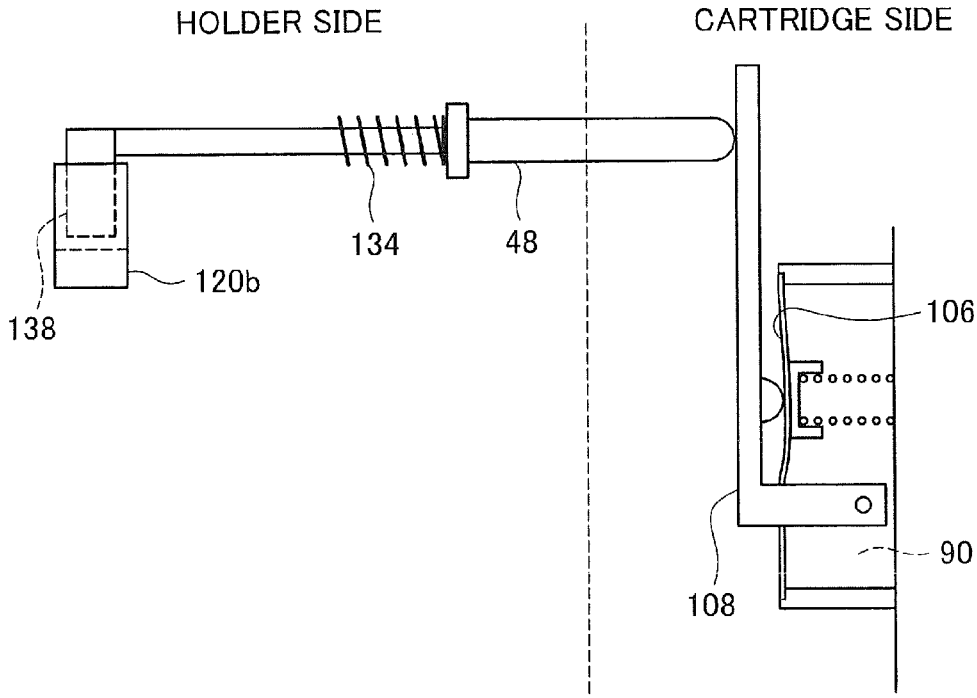
FIG. 16 shows detecting the presence or absence of ink by the sensor provided inside the cartridge holder.
Figure 17:
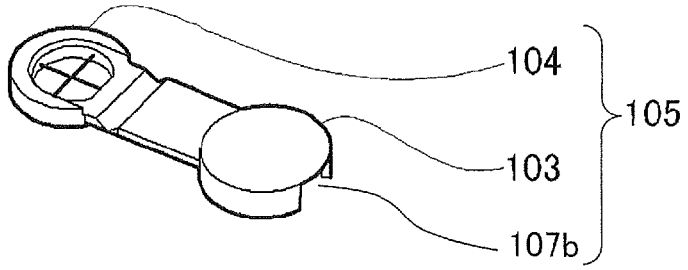
FIG. 17 illustrates a cutout provided in a spring-receiving element according to one modification.

FIGS. 15 and 16 show detecting the presence or absence of ink in the cartridge 40 by the photosensor 120*b* provided inside the cartridge holder 42. When the cartridge 40 is attached to the cartridge holder 42, a peripheral end of the rod 48 abuts a peripheral end of the lever member 108 provided on the cartridge 40 as shown in FIG. 15. When ink is present in the ink detection chamber 90, the rod 48 is moved to the back side (−Y-axis direction side) of the cartridge holder 42 by means of the lever member 108. The light shielding member 138 of the rod 48 is then separated from the sensor 120*b*, so that the sensor 120*b* falls in the state of light transmission. When ink is absent in the ink detection chamber 90, on the other hand, the rod 48 presses back the lever member 108 toward the cartridge 40 On the +Y-axis direction) by the pressing force of the spring 134. The light shielding member 138 of the rod 48 then moves into the sensor 120*b*, so that the photosensor 120*b* falls in the light shielded state. In this manner, the photosensor 120*b* can detect the state of remaining ink in the cartridge 40, depending on whether the light is shielded by the light shielding member 138 provided at a rear end (−Y-axis end) of the rod 48.

The foregoing has described the invention in detail with reference to the illustrative embodiment. The invention is, however, not limited to the above embodiment, but a multiplicity of variants and modifications may be made to the embodiment without departing from the scope of the invention. Some examples of possible modifications are described below.

Modification 1

In the ink detector 84 of the cartridge 40 according to the embodiment described above, the cutout 107 of the spring-receiving element 103 is formed by cutting out the whole height of the spring-receiving element 103 to the upper surface (surface abutting the film 106). It is, however, not necessary to cut out the whole height of the spring-receiving element 103 to its upper surface, as long as the cutout of the light-receiving element 103 can form a space, through which air bubbles pass. For example, a cutout 107*b* may be provided only in the side face (side wall) extended downward from the upper surface of the spring-receiving element 103.

Figure 18:
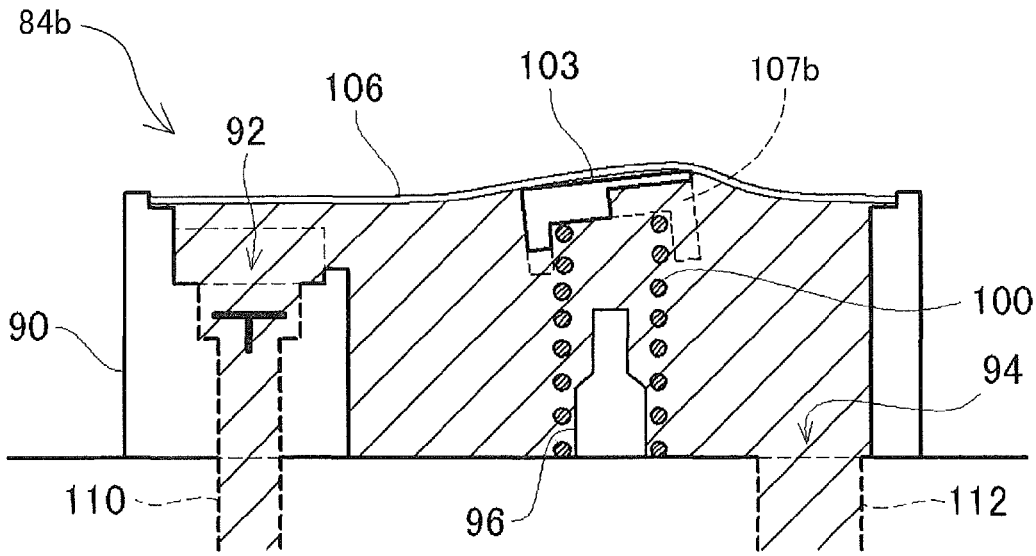
FIG. 18 illustrates inside of an ink detector according to the modification.

FIG. 18 illustrates inside of the ink detector 84*b* according to one modification. In the ink detector 84*b* according to this modification, the thickness of the spring-receiving element 103 shown in FIG. 18 is made greater than the thickness of the spring-receiving element 103 shown in FIGS. 7 and 8. The spring-receiving element 103 of FIG. 18 has the cutout 107*b* of the same depth at the same position as that of the cutout 107 of the spring-receiving element 103 shown in FIGS. 7 and 8.

As described above, the pressing force is applied onto the upper surface of the spring-receiving element 103 by means of the lever member 108 (FIGS. 5 and 6). Providing the cutout 107*b* only in the side face of the spring-receiving element 103 as explained above advantageously enhances the durability of the spring-receiving element 103 against the pressing force of the lever member 108, while ensuring removal of air bubbles accumulated on the abutting face of the spring-receiving element 103 against the spring 100.

Modification 2

According to the embodiment described above, the ink pack 70 is directly fixed (welded) to the ink supply member 74. According to one modification, the ink supply member 74 and the ink pack 70 may be interconnected by means of a flow path member, such as a tube. In this modification, the main body casing 76 may be omitted according to the requirements.

Modification 3

According to the embodiment described above, the ink filler port 80, the ink supply port 82, the ink detector 84 and the connection port 92 are provided along the longitudinal direction on the surface 75 of the ink supply member 74. According to one modification, two or more of these elements may be provided in a direction orthogonal to the longitudinal direction. More specifically, for example, the ink filler port 80 and the ink supply port 82 may be arranged to be aligned in the direction orthogonal to the longitudinal direction. The ink filler port 80, the ink supply port 82, the ink detector 84 and the connection port 92 are arranged in a line according to the above embodiment, but may be arranged in zigzag or may be arranged at discrete positions with different intervals from a straight line parallel to the longitudinal direction.

Modification 4

The above embodiment describes the cartridge 40 including the ink detector 84. The cartridge 40 may be structured without the ink detector 84. In other words, the connection port 92 and the ink supply port 82 may be directly connected with each other by means of a flow path without the ink detector 84. In this modification, when the flow path connecting the connection port 92 with the ink supply port 82 does not have any portion directed in an opposite direction (+Y-axis direction) to the direction, in which the ink supply port 82 is directed (−Y-axis direction), the operation of step S60, i.e., the operation of changing the attitude of the cartridge 40 to the second attitude to expel air bubbles from the ink supply port 82, may be omitted in the manufacturing method of the cartridge shown in FIG. 9. In the cartridge 40 structured with the ink detector 84, the operation of step S60 may also be omitted according to the requirements. In some applications, even when the operation of step S60 is omitted, the operation of step S50 may be sufficient to expel the air bubbles.

Modification 5

The present invention is not restricted to the printing device and its cartridge but is applicable to any of various liquid ejection devices adapted to eject a liquid other than ink and its liquid container, for example, liquid ejection devices and their liquid containers given below:

(1) image recording device, such as a facsimile machine;

(2) color material ejection device used to manufacture color filters for image display devices, e.g., liquid crystal displays;

(3) electrode material ejection device used to form electrodes of, for example, organic EL (electroluminescence) displays and field emission displays (FED);

(4) liquid ejection device adapted to eject a bioorganic material-containing liquid used for manufacturing biochips;

(5) sample ejection device used as a precision pipette;

(6) lubricating oil spray device;

(7) resin solution spray device;

(8) liquid spray device for pinpoint spray of lubricating oil at precision machinery including watches and cameras;

(9) liquid ejection device adapted to eject transparent resin solution, such as ultraviolet curable resin solution, onto the substrate, so as to manufacture a hemispherical microlens (optical lens) used for, for example, optical communication elements;

(10) liquid spray device adapted to spray an acidic or alkaline etching solution, in order to etch the substrate; and

(11) liquid ejection device equipped with liquid ejection head for ejecting a very small volume of droplets of another arbitrary liquid.

The "liquid droplet" means a state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The "ink" includes general water-based inks and oil-based inks, as well as various liquid compositions, such as gel inks and hot-melt inks.

What is claimed is:

1. A manufacturing method of a cartridge adapted to be removably attached to a printing device, the cartridge comprising:

a liquid container adapted to contain a liquid;

a filler port provided to fill the liquid into the liquid container;

a supply port connected with a liquid supply tube provided in the printing device;

a connection port provided to communicate with the liquid container;

a flow path arranged to connect the connection port with the supply port; and a member provided to have the filler port, the supply port and the connection port arranged on one identical surface, wherein the surface of the member has the supply port and the filler port arranged on one direction side relative to center of the surface, and the connection port arranged on an opposite direction side to the one direction side relative to the center, the manufacturing method comprising the steps of:

(a) injecting the liquid into the liquid container through the filler port;

(b) after the step (a), setting an attitude of the cartridge to a first attitude that the filler port is located above the connection port in a vertical direction and a normal vector of the surface is inclined upward in the vertical direction from a horizontal direction at an angle of not less than +1 degree and less than +90 degrees, and expelling air bubble from the filler port and the supply port in the first attitude; and (c) after the step (b), closing the filler port.

2. The manufacturing method according to claim 1, wherein at least part of the flow path is arranged to be directed in an opposite direction to a direction, in which the supply port is directed, the manufacturing method further comprising the step of:

(d) after the step (b), changing the attitude of the cartridge from the first attitude to a second attitude that the filler port is located above the connection port in the vertical direction and the normal vector of the surface is inclined upward in the vertical direction from the horizontal direction at an angle of not less than −45 degrees and less than +1 degree, and expelling air bubble from the supply port in the second attitude.

3. The manufacturing method according to claim 2, wherein the step (d) expels part of the filled liquid together with the air bubble.

4. The manufacturing method according to claim 2, wherein the angle in the second attitude is not less than −40 degrees and not greater than 0 degree.

5. The manufacturing method according to claim 1, wherein the step (b) expels part of the filled liquid together with the air bubble.

6. The manufacturing method according to claim 1, wherein the step (a) injects the liquid after setting the cartridge in the first attitude.

7. The manufacturing method according to claim 1, further comprising the step of:

(d) prior to the step (a), reducing pressure in the liquid container.

8. The manufacturing method according to claim 1, wherein the step (a) injects the liquid while bringing a restriction tool adapted to restrict expansion of the liquid container into contact with the cartridge.

9. The manufacturing method according to claim 1, wherein the angle in the first attitude is not less than +5 degrees and not greater than +85 degrees.

10. A cartridge manufactured by the manufacturing method according to claim 1.

11. A cartridge adapted to be removably attached to a printing device, comprising:

a liquid container adapted to contain a liquid;

a filler port provided to fill the liquid into the liquid container;

a supply port connected with a liquid supply tube provided in the printing device;

a connection port provided to communicate with the liquid container;

a liquid detection chamber adapted to vary volume according to inflow or non-inflow of the liquid through the connection port;

a flow path arranged to connect the liquid detection chamber with the supply port; and a member provided to have the filler port, the supply port, the liquid detection chamber and the connection port arranged on one identical surface, wherein the surface of the member has the supply port and the filler port arranged on one direction side relative to center of the surface, and the connection port arranged on an opposite direction side to the one direction side relative to the center, and the liquid detection chamber is located between the connection port and the supply port.

12. The cartridge according to claim 11, further comprising:

a pressure-receiving member provided inside the liquid detection chamber; and a pressing member provided to press a variable element, which is provided in part of the liquid detection chamber, via the pressure-receiving member from inside of the liquid detection chamber, wherein the pressure-receiving member has a receiving element adapted to receive the pressing member, and a cutout formed in part of the receiving element.

13. The cartridge according to claim 11, wherein the liquid container has a side along the surface, the filler port is connected with one end of the side, and the connection port is connected with the other end of the side.

14. The cartridge according to claim 11, wherein the filler port is closed after the liquid is injected into the liquid container.

15. The cartridge according to claim 11, further comprising:

a casing adapted to accommodate the liquid container and the member.

16. The cartridge according to claim 11, wherein the surface is formed in an approximately rectangular shape.

17. The cartridge according to claim 16, wherein the filler port, the supply port, the liquid detection chamber and the connection port are arranged along a longitudinal direction of the surface.

5

* * * * *